United States Patent [19]

Kapare

[11] Patent Number: 5,016,811

[45] Date of Patent: May 21, 1991

[54] END WALL MEMBER FOR USE WITH BOXES

[76] Inventor: Gunnar Kapare, S-421 47 Västra Frölunda, Kantyxegatan 2 A, Sweden

[21] Appl. No.: 536,582

[22] PCT Filed: Dec. 21, 1988

[86] PCT No.: PCT/SE88/00695

§ 371 Date: Aug. 24, 1990

§ 102(e) Date: Aug. 24, 1990

[87] PCT Pub. No.: WO89/06209

PCT Pub. Date: Jul. 13, 1989

[30] Foreign Application Priority Data

Dec. 28, 1987 [SE] Sweden ..... 8705159

[51] Int. Cl.[5] ..... B65D 5/44

[52] U.S. Cl. ..... 229/23 R; 229/915

[58] Field of Search ..... 229/23 R, 915, DIG. 11; 206/509

[56] References Cited

U.S. PATENT DOCUMENTS

| | | | |
|---|---|---|---|
| 3,373,921 | 3/1968 | Crane | 229/23 R |
| 3,409,202 | 11/1968 | Belcher | 229/23 R |
| 3,417,909 | 12/1968 | Stern | 229/23 R |
| 3,915,372 | 10/1975 | Crane | 229/23 R |
| 3,935,991 | 2/1976 | Crane | 229/23 R |
| 4,068,794 | 1/1978 | Lawrence | 229/23 R |
| 4,482,074 | 11/1984 | Lalley | 229/23 R |
| 4,807,756 | 2/1989 | Young et al. | 206/509 |

*Primary Examiner*—Gary E. Elkins

*Attorney, Agent, or Firm*—Harness, Dickey & Pierce

[57] ABSTRACT

An end wall member intended to be used together with boxes of the kind which are made from cardboard, corrugated paperboard and the like and which are formed at two opposite side walls with flaps which are intended to be folded inwards into abutment against said walls. The end wall member consists of two plane-parallel walls separated by an intermediate gap. A crosswise extending wall forms the bottom of the gap.

To fit the box with the end wall member the box flaps are inserted into the gap and pressed downwards sufficiently far to ensure that these flaps abut against the crosswise wall. In this position, the end wall member will be frictionally secured to its respective one of the box side walls.

10 Claims, 5 Drawing Sheets

END WALL MEMBER FOR USE WITH BOXES

BACKGROUND OF THE INVENTION

The subject invention concerns a member designed to form an end wall in boxes made from cardboard, corrugated paperboard and the like.

Boxes made from these materials are used to transport and store a large variety of different goods. However, both during the transport and the storage of goods in cardboard or corrugated paperboard boxes it is important that the latter are stackable. To allow the boxes to be stacked on top of each other, at least two opposite sides of the box are reinforced. The reinforcement may be achieved for instance by forming the box with double walls or by providing it with separate flaps which are arranged to be folded inwards or downwards in a predetermined manner. In a separate operation the flaps may be stapled or glued to the box side walls to serve as reinforcement means and/or as stacking ribs.

Boxes made of any one of these materials and designed as indicated, are more expensive to manufacture than plain boxes, the sole purpose of which is to serve as a package. The added expense is felt all the more when the box, thus reinforced, nevertheless is used only for one-way transports and therefore, in effect, serves as a disposable package.

SUMMARY OF THE INVENTION

The purpose of the subject invention is to provide a solution to this problem. More precisely, the invention concerns an end wall member which is intended for use together with boxes of cardboard, corrugated paperboard, et cetera of the kind which, from a knocked-down position, are formed by erecting four side walls vertically relatively to a floor section and by folding flaps flat against the external faces of two opposite ones of said four box side walls. The end wall member is characterized therein that it comprises two plane-parallel walls which are separated by a gap, and a transverse wall forming the bottom of the gap, and in that the end wall member is arranged to be connected to one of those box side walls that are provided with the flaps by inserting said flaps into the gap sufficiently far to ensure that the flaps engage said transverse wall.

Thanks to this end wall member a box is obtained which is very light and easy to lift and stack and which is cheap because the end wall member may be removed from the box proper, the latter being of a very simple design and structure, and the end wall member may be used again with a fresh box when the first one is discarded.

BRIEF DESCRIPTION OF THE DRAWINGS.

The invention will be described in closer detail in the following with reference to the accompanying drawings, wherein.

DETAILED DESCRIPTION OF PREFERRED EMBODIMENTS

Figure 1:
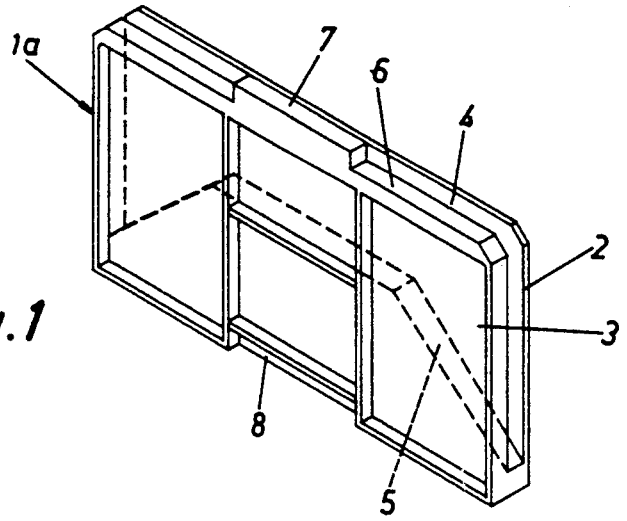
FIG. 1 is a perspective view of the end wall member in accordance with a first embodiment thereof.

The end wall member 1*a*, 1*b* in accordance with the invention consists of two plane-parallel walls 2, 3 which are separated by a gap 4. A transverse wall portion 5 extending between the walls 2 and 3 in the interior of the gap 4, forms the bottom of the gap 4. The wall 3 has a peripheral reinforcement ledge which forms an upper edge face 6 serving as a stacking edge or rail and also as a gripping face, allowing the box to be lifted with ease. The end wall members 1*a*, 1*b* in accordance with the embodiments illustrated in the drawings also are formed at their top edge with a lug 7 and at their lower edge with a notch 8 of matching configuration so that in said notch may be received a lug formed in another end wall member to allow the boxes to be stacked one on top of the other.

Figure 2:
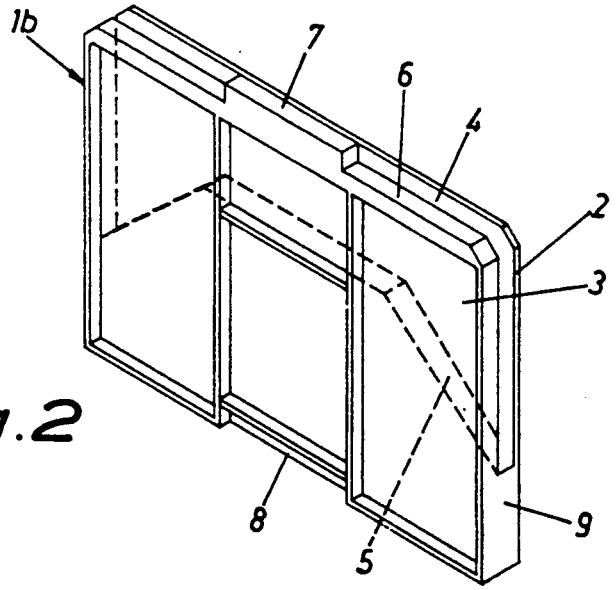
FIG. 2 is a similar view of the end wall member in accordance with another embodiment.

In accordance with the embodiment illustrated in FIG. 2 the end wall member 1*b* is extended at its lower edge by means of a downwards projecting shoulder 9, the purpose of which will be explained in further detail in the following.

Figure 3:
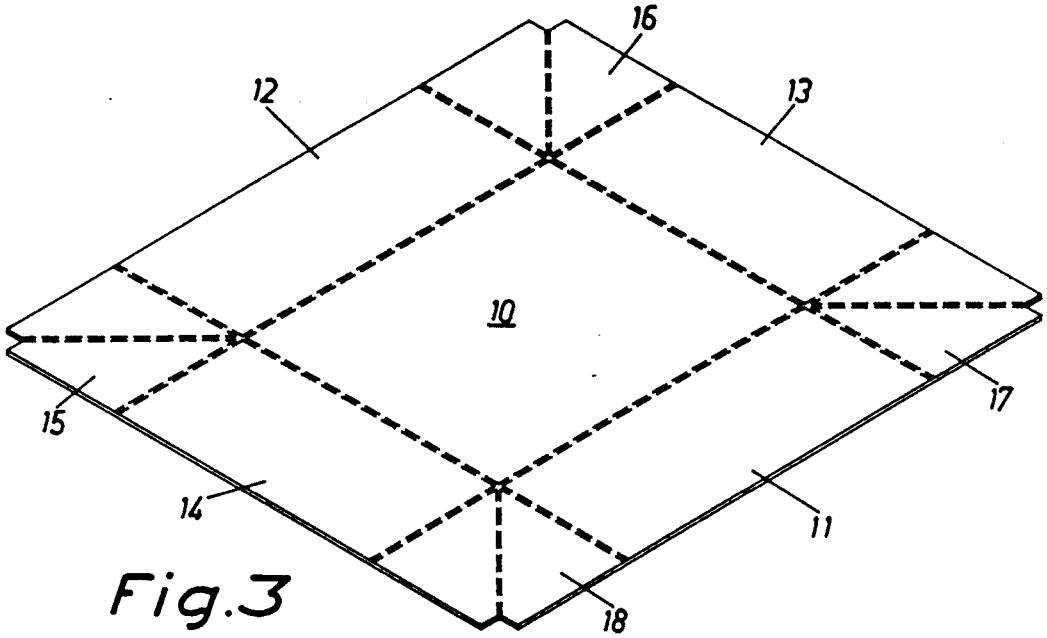
FIG. 3 is a perspective view of a box blank in accordance with a conventional design.
Figure 4:
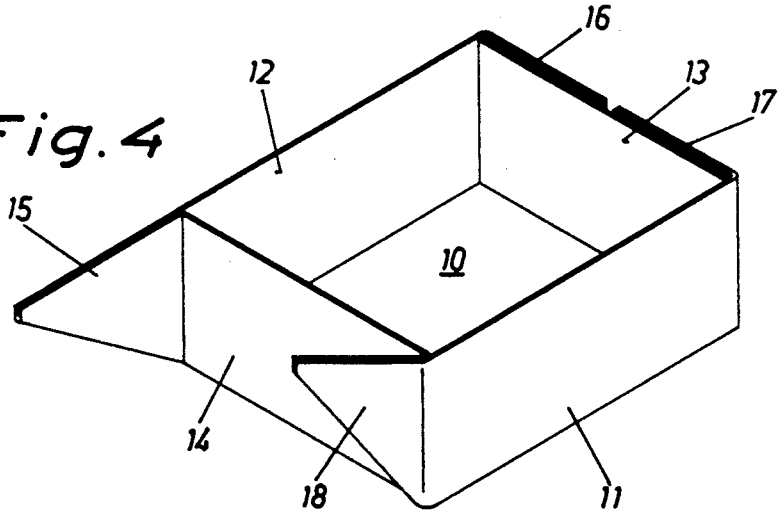
FIG. 4 illustrates the box blank, when the erection thereof to form the box has been almost completed.

FIG. 3 illustrates a box blank which is intended to be used together with the end wall member in accordance with the invention. The box blank consists of a floor section 10, four side wall sections 11, 12, 13 and 14 and four corner sections 15, 16, 17 and 18. The box blank is erected in the manner appearing from FIG. 4, and in the erected condition of the box the corner sections 15 and 18 form flaps which are folded inwards so as to abut against the outer face of wall section 14 whereas corner sections 16 and 17 form flaps which are folded inwards into abutment against the outer face of wall section 13. The flaps are not, however, secured to the external face of their respective wall section.

Figure 6:
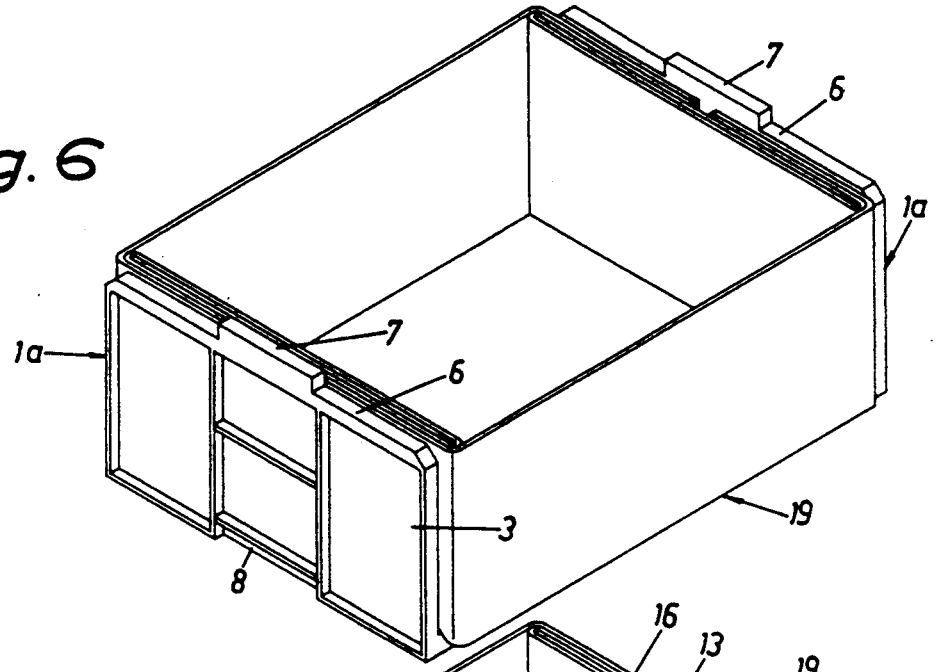
FIG. 6 is a perspective view of a finished box, fitted with the end wall members in accordance with the invention.
Figure 5:
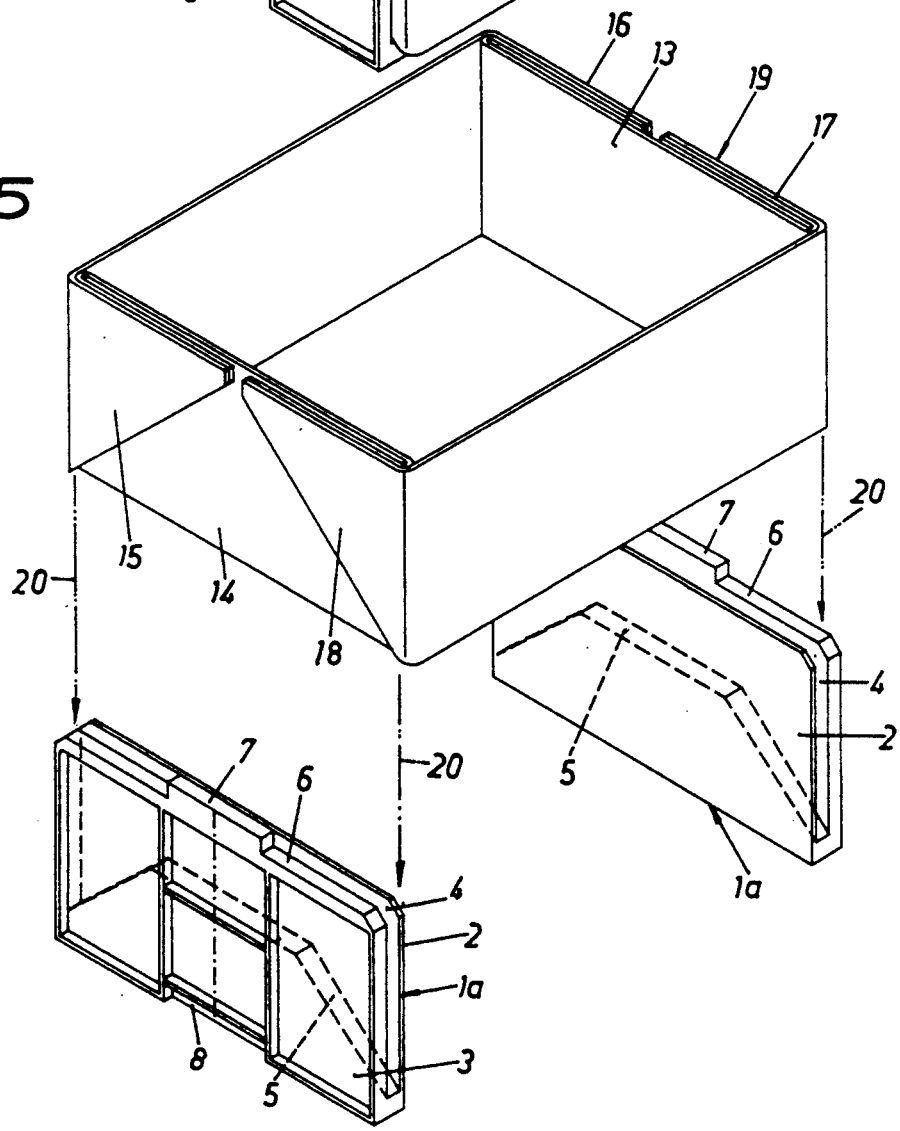
FIG. 5 is a perspective view of the box having been erected from the blank shown in FIG. 3 and illustrating the mounting of the end wall members in accordance with the invention in position on two opposite box walls.

The box blank is erected in the conventional manner by being pressed downwards through an erection shaft. In the shaft, a box 19 is formed having the appearance illustrated in FIG. 5. For the sake of simplicity, the erection shaft has been deleted from the drawings. Below the erection shaft, not shown, are positioned two rows of end wall members in accordance with the invention. However, only one end wall member 1*a* is illustrated in FIG. 5 in a position below its respective one of the two opposite positioned side walls 13, 14 of the box 19. When the box 19 is pressed downwards in the direction illustrated by arrows 20, the flaps 15, 18 and 16, 17 are guided into their respective one of the gaps 4 in the two end wall members 1*a*. The box 19 is depressed sufficiently far to ensure that the lower edges of the flaps 15, 18 and 16, 17 abut against the associated transverse wall 5. In this position, the end wall members 1*a* are frictionally retained in abutting position against the box side walls 13 and 14, respectively, and the box 19 with the end wall members fitted thereon as illustrated in FIG. 6 is removed to provide space for the following box blank.

Figure 7:
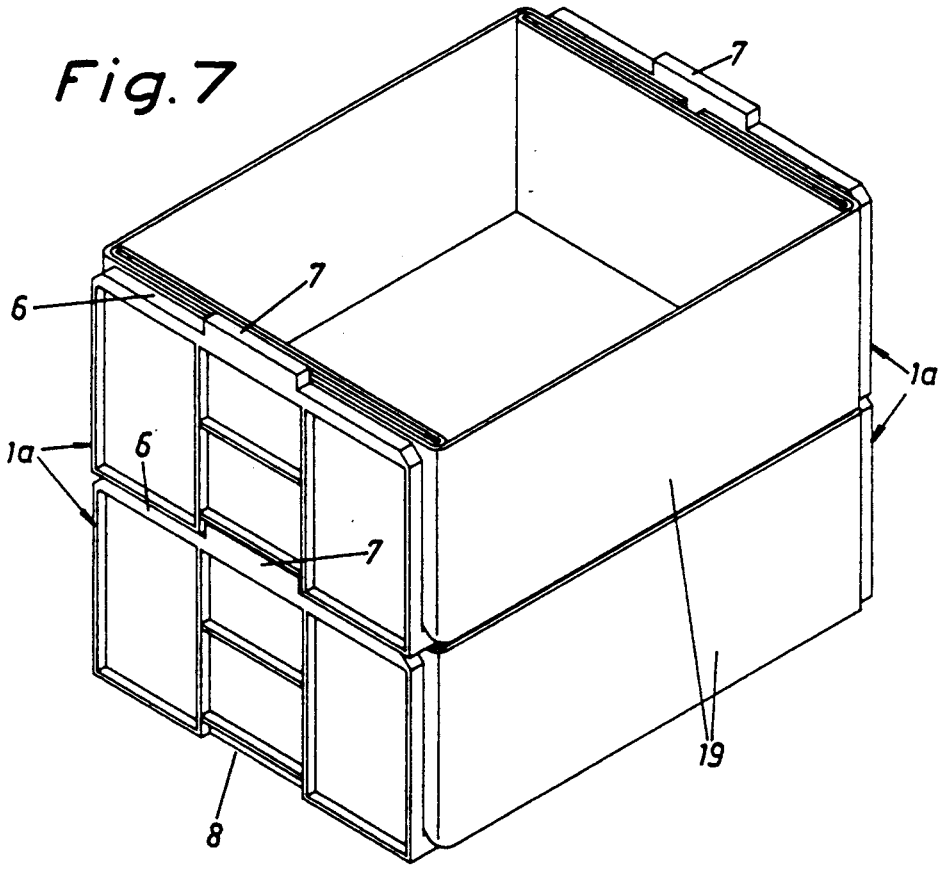
FIGS. 7 and 8 are perspective views of two different ways of making the boxes stackable.

FIG. 7 illustrates the manner in which the end wall members 1*a*serve as stacking supports when two boxes 19 are to be stacked one on top of the other. The upper end wall member 1*a* rests on the edge face 6 on the lower end wall member 1*a* while the lug 7 on the latter projects into the notch 8 formed in the upper end wall member. The load of the upper box 19 on the box 19 below thus is reduced while at the same time the upper box is retained firmly in place on top of the lower one, owing to the interengagement of the two end wall members. When the upper box 19 is to be lifted off the lower one, this operation is easily performed because the lower face of the edge 6 may be easily gripped by the fingers.

Figure 8:
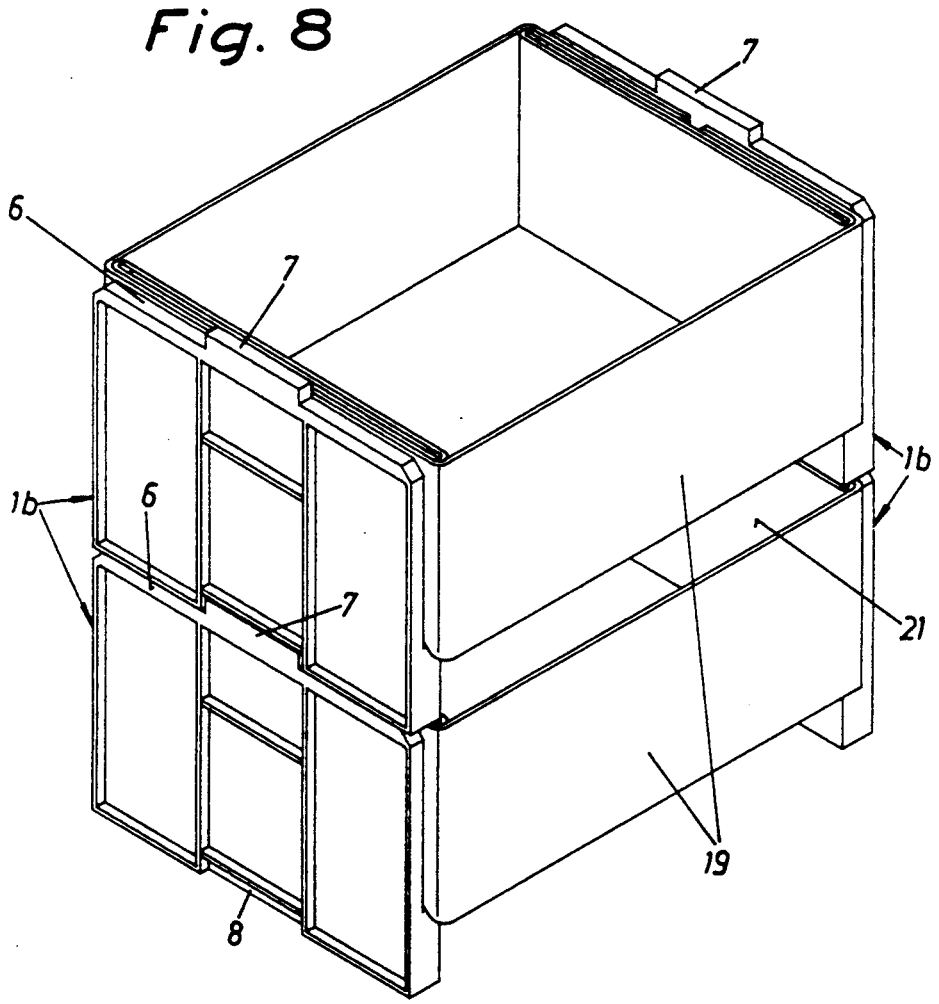

FIG. 8 shows a modification according to which the end wall member 1*b* is extended downwards by means of a shoulder 9. When boxes 19 fitted with this kind of end wall member 1*b*, are stacked, one on top of the other, a gap 21 is formed between the boxes. This is an advantage when the boxes contain fresh food, such as fish, to be deep-frozen. When the boxes 19 are stored in a deep-freezing chamber, the cold air can flow around each individual box, thus accelerating the deep-freezing effect.

The gap 21 is also advantageous when a fork lift truck is used to stack the boxes into a pile or to remove individual boxes from a pile of boxes.

The end wall member 1*a*, 1*b* in accordance with the invention is suitable for repeated intercompany uses. However, it could also accompany its box (package) during transportation and be returned, piled together with a number of other end wall members, for re-use. Alternatively, when the end wall members are made from synthetic resin, they may be ground into granules to be used for other purposes within the plastics industry.

When the end wall member 1*a*, 1*b* is removed from its associated box 19 the flaps 15, 16, 17, 18 will open resiliently outwards and thus facilitate the knocking-down of the box into a flat box blank. Box blanks of this kind are easy to stack in tight bundles and therefore they require a minimum of space when transported to waste paper plants for re-utilization. In addition to being economical this procedure also is time-saving compared with the time required to tear up a box of conventional manufacture.

The simple known-down procedure of the box into a flat blank is advantageous also when deep-frozen products are stored in the box. When e.g. fish is stored inside the box, in frozen condition in a block of ice, it is normally difficult to detach the ice-block from the box. When the end wall members 1*a*, 1*b* in accordance with the invention are used, the members are simply removed and the box side walls 11, 12, 13 and 14 are folded downwards, thus facilitating this handling operation quite considerably.

Application on the upper face of the box blank which in the finished box forms the inner face, of a water-impervious layer, makes the finished box fully waterproof. Moist products may therefore be stored inside the box without risk of leakage of liquid to the exterior.

The end wall member 1*a*, 1*b* could, of course, be designed otherwise than illustrated and described without departure from the scope of the appended claims. For instance, the box 19 could be formed with a lid having downwardly directed flaps which may be inserted into the gap 4 laterally of the box flaps 15, 18 and 16, 17, respectively.

What I claim is:

1. An end wall member designed to be used together with boxes of cardboard, corrugated paperboard and the like, said boxes being formed by erecting four side walls vertically from a floor section and by folding flaps flat against the external faces of two opposite ones of said four box side walls, characterized therein that the end wall member comprises two plane-parallel walls which are separated by a gap, and a transverse wall forming the bottom of the gap, and in that the end wall member is arranged to be connected to one of those box side walls that are provided with the flaps by inserting said flaps into the gap sufficiently far to ensure that the flaps engage said transverse wall.

2. An end wall member as claimed in claim 1, characterized therein that the end wall member wall which faces outwards when the end wall member is fitted on a box side wall, is formed at its top with an edge face which reinforces the wall and serves as a stacking edge when several boxes, fitted with end wall members, are stacked one on top of the other.

3. An end wall member as claimed in claim 2, characterized therein that the edge face is provided with a lug arranged to engage in a matching notch formed in the end wall member fitted on the box immediately above, when a number of boxes, fitted with end wall members, are piled one on top of the other.

4. An end wall member as claimed in claim 2 characterized therein that the edge face serves as a lifting handle.

5. An end wall member as claimed in claim 1 characterized therein that the end wall member has a downwards extended shoulder, whereby, when a number of boxes are stacked one on top of the other, a gap is formed between the boxes.

6. An end wall member as claimed in claim 3 characterized therein that the edge face serves as a lifting handle.

7. An end wall member as claimed in claim 2 characterized therein that the end wall member has a downwards extended shoulder, whereby, when a number of boxes are stacked one on top of the other, a gap is formed between the boxes.

8. An end wall member as claimed in claim 3 characterized therein that the end wall member has a downwards extended shoulder, whereby, when a number of boxes are stacked one on top of the other, a gap is formed between the boxes.

9. An end wall member as claimed in claim 4 characterized therein that the end wall member has a downwards extended shoulder, whereby, when a number of boxes are stacked one on top of the other, a gap is formed between the boxes.

10. An end wall member as claimed in claim 6 characterized therein that the end wall member has a downwards extended shoulder, whereby, when a number of boxes are stacked one on top of the other, a gap is formed between the boxes.

* * * * *